US011059700B2

(12) United States Patent
Zhu et al.

(10) Patent No.: US 11,059,700 B2
(45) Date of Patent: Jul. 13, 2021

(54) LARGE-TONNAGE SKIP ANTI-BLOCKING SYSTEM

(71) Applicant: CHINA UNIVERSITY OF MINING AND TECHNOLOGY, Xuzhou (CN)

(72) Inventors: Zhencai Zhu, Xuzhou (CN); Guohua Cao, Xuzhou (CN); Gongbo Zhou, Xuzhou (CN); Yu Tang, Xuzhou (CN); Fan Jiang, Xuzhou (CN); Gang Shen, Xuzhou (CN); Hao Lu, Xuzhou (CN); Yuxing Peng, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 16/765,876

(22) PCT Filed: Sep. 12, 2019

(86) PCT No.: PCT/CN2019/105578
§ 371 (c)(1),
(2) Date: May 21, 2020

(87) PCT Pub. No.: WO2020/119199
PCT Pub. Date: Jun. 18, 2020

(65) Prior Publication Data

US 2020/0391979 A1 Dec. 17, 2020

(30) Foreign Application Priority Data

Dec. 14, 2018 (CN) ..... 201811531513.X

(51) Int. Cl.
*B66B 17/26* (2006.01)
*B66B 7/02* (2006.01)
(Continued)

(52) U.S. Cl.
CPC ..... *B66B 17/26* (2013.01); *B66B 7/02* (2013.01); *B66B 17/08* (2013.01); *E21F 13/00* (2013.01)

(58) Field of Classification Search
CPC . B66B 17/26; B66B 7/02; B66B 17/08; E21F 13/00
See application file for complete search history.

(56) References Cited

U.S. PATENT DOCUMENTS 3,378,153 A * 4/1968 Domenighetti ..... B66B 9/06 414/598
4,932,427 A * 6/1990 Yamada ..... B65G 49/0459 134/66

(Continued)

FOREIGN PATENT DOCUMENTS

CN 201793183 U 4/2011
CN 106185080 A 12/2016

(Continued)

*Primary Examiner* — Jeffrey Donels
(74) *Attorney, Agent, or Firm* — Bayramoglu Law Offices LLC

(57) ABSTRACT

A large-tonnage skip anti-blocking system includes a skip, wherein two parallel rows of guide rails are fixed to upper and lower shaft walls of a shaft on two sides of the skip correspondingly, a plurality of pulleys are mounted on the guide rails in a matched mode, impact plates are mounted between the upper and lower pulleys, front plates of the impact plates are mounted between the upper and lower sets of pulleys in the front row, rear plates of the impact plates are mounted between the upper and lower sets of pulleys in the back row, a length of rib plates of the impact plates is greater than a width of the skip, hydraulic cylinder bases and vibration motors are mounted on outer sides of the rib plates at intervals.

7 Claims, 2 Drawing Sheets

(51) Int. Cl.
*B66B 17/08* (2006.01)
*E21F 13/00* (2006.01)

(56) References Cited

U.S. PATENT DOCUMENTS

| | | | | |
|---|---|---|---|---|
| 5,765,662 | A * | 6/1998 | Mellen | B66B 17/06 187/245 |
| 10,053,292 | B2 * | 8/2018 | Werre | B65G 47/58 |
| 2014/0110194 | A1 * | 4/2014 | Zhu | B66B 17/04 187/254 |
| 2020/0339388 | A1 * | 10/2020 | Peng | B66B 17/26 |

FOREIGN PATENT DOCUMENTS

| | | | |
|---|---|---|---|
| CN | 109704181 | A | 5/2019 |
| DE | 102004031979 | B4 | 9/2012 |
| JP | 2001158584 | A | 6/2001 |

* cited by examiner

LARGE-TONNAGE SKIP ANTI-BLOCKING SYSTEM

CROSS REFERENCES TO THE RELATED APPLICATIONS

This application is the national phase entry of International Application No. PCT/CN2019/105578, filed on Sep. 12, 2019, which is based upon and claims priority to Chinese Patent Application No. 201811531513.X, filed on Dec. 14, 2018, the entire contents of which are incorporated herein by reference.

TECHNICAL FIELD

The present invention relates to a mining skip, in particular to a large-tonnage skip anti-blocking system, and belongs to the technical field of mine lifting.

BACKGROUND

In a lot of links of coal mine production, safe and reliable operation of a mine lifting loading system is very important to safe and efficient production of a mine, and a mining skip is a main device of the mining lifting loading system. After coal is loaded into the skip through a loading device underground and lifted to an aboveground unloading position, a skip gate is opened by a gate opening and closing device to unload the coal into a coal feeding bunker, and after unloading, the skip gate is closed, and the skip goes away from the unloading position, and is lowered to a mine bottom for coal re-loading.

With development of coal mine production towards a large scale, high yield and high efficiency, a large-tonnage skip is more and more widely applied to a mine lifting system. The large-tonnage skip has the structural characteristics that the height is large, the cross-section area is small, and in a loading process of the skip, coal bodies fall continuously to make coal at the bottom of a skip box compacted under an effect of impact loads, leading to unloading blocking after gate opening; coal on an upper part of the skip box is prone to being suspended and cannot be unloaded due to large upward friction force and small downward impact force; and the skip height is large, a winch lifting cycle is too long, and time of loading and unloading is long, leading to the skip being prone to being blocked.

According to a current unblocking method, when unloading blocking occurs to the skip, a coal miner hammers the skip by a hammer to shake the coal off, which consumes long unblocking time and is high in labor intensity and not safe. Lifting efficiency of a coal mine is affected seriously by skip blocking, easily leading to secondary misoperation, improper handling even causing safety accidents, and production is affected.

SUMMARY

In order to overcome various shortcomings in the prior art, the present invention provides a large-tonnage skip anti-blocking system. The problem of skip blocking may be effectively reduced, a structure is simple, normal work of a skip is not influenced, and safety and working efficiency of a mining lifting system are improved.

In order to achieve the above invention objective, the large-tonnage skip anti-blocking system according to the present invention includes a skip, wherein two parallel rows of guide rails are fixed to upper and lower shaft walls of a shaft on two sides of the skip correspondingly, a plurality of pulleys are mounted on the guide rails in a matched mode, impact plates are mounted between the upper and lower pulleys, front plates of the impact plates are mounted between the upper and lower sets of pulleys in the front row, rear plates of the impact plates are mounted between the upper and lower sets of pulleys in the back row, a length of rib plates of the impact plates is greater than a width of the skip, hydraulic cylinder bases and vibration motors are mounted on outer sides of the rib plates at intervals, one ends of hydraulic cylinders are connected to the hydraulic cylinder bases through buffer springs, the other ends of the hydraulic cylinders are connected with the shaft wall of the shaft, and piston rods of the hydraulic cylinders push inner sides of the rib plates of the impact plates to be closely attached to an outer wall of the skip when extending out.

When skip blocking is caused by adhering of materials to an inner wall of the skip, the hydraulic cylinders push the impact plates to horizontally move towards the skip, and when the rib plates of the impact plates are closely attached to the outer wall of the skip, the vibration motors are started, and the materials blocking the inner wall of the skip are shaken off through small-amplitude and high-frequency vibration provided by the vibration motors; when adhesion is large, the vibration motors can be stopped, telescopic impact force of the hydraulic cylinders makes the skip generate large-amplitude and high-frequency vibration, and thus blocking caused by the large-adhesion materials is solved; a cooperation effect of extending and retraction of the hydraulic cylinders and the vibration motors may further be utilized to thoroughly remove the blocking materials to make the adhesion materials separated from the inner wall of the skip and unloaded from an unloading opening due to a gravity effect; and the buffer springs can reduce force of the vibration motors being transmitted to the hydraulic cylinders so as to prevent damage to the hydraulic cylinders during vibration of the vibration motors.

In order to make the impact force of the hydraulic cylinders to the skip more even, the hydraulic cylinders are mounted on fixed seats, the fixed seats are fixed to lower end shaft walls of the shaft, and a height of the fixed seats is half a height of the shaft.

Preferably, the hydraulic cylinders are arranged into four sets, and evenly and symmetrically mounted on left and right sides of the skip, and a horizontal distance between the two hydraulic cylinders on each side is one third a width of the shaft.

When the height of the shaft is small, one vibration motor is arranged on the outer side of each of the impact plates on two sides, and the vibration motor is mounted between the two hydraulic cylinders; when the materials are high in humidity and adhesion, two vibration motors are arranged on the outer side of each of the impact plates on the two sides, and the vibration motors are mounted on two sides of the two hydraulic cylinders; and when the height of the shaft is large, three vibration motors are arranged on the outer side of each of the impact plates on the two sides, and the vibration motors are mounted on the two sides of the two hydraulic cylinders and between the two hydraulic cylinders.

Further, the pulleys are correspondingly connected with the front plates and the rear plates of the impact plates through H-shaped connecting plates.

In the present invention, a combination effect of the vibration motors and the hydraulic cylinders is adopted to force the materials adhering to the inner side of the skip to be shaken off, the vibration motors can provide small-amplitude and high-frequency vibration force, and the hydraulic cylinders can provide large-amplitude and low-frequency vibration force, so that different vibration modes are selected according to different working conditions or both are cooperatively used; the vibration motors are wide in vibration frequency range, can achieve stepless adjustment, and are convenient to control and high in efficiency, and moreover, the motors are small in size and weight and stable in rotation; an airtight structure is adopted overall, and the anti-dirty ability is high; and the hydraulic cylinders enable a device to move left and right and thus going away from the skip when blocking resisting is not needed, so that the normal work of the skip will not be affected.

In drawings: 1 denotes a guide rail; 2 denotes a pulley; 3 denotes a connecting plate; 4 denotes an impact plate; 41 denotes a front plate; 42 denotes a rear plate; 43 denotes a rib plate; 5 denotes a vibration motor; 6 denotes a hydraulic cylinder base; 7 denotes a buffer spring; 8 denotes a hydraulic cylinder; 9 denotes a fixing plate; and 10 denotes a skip.

DETAILED DESCRIPTION OF THE EMBODIMENTS

The present invention will be described in detail below with reference to the accompanying drawings and specific embodiments.

Embodiment 1

Figure 1:
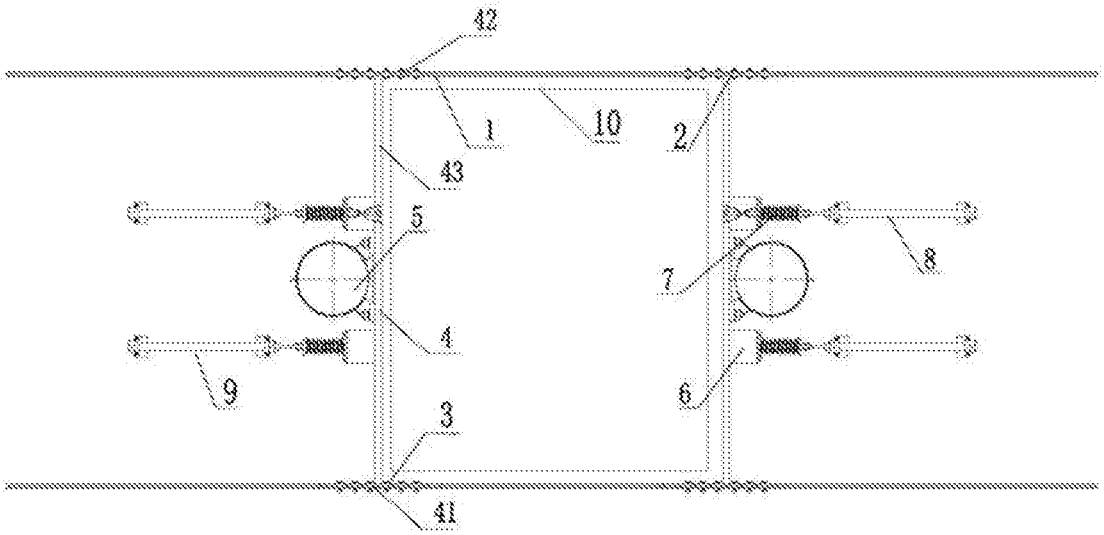
FIG. 1 is a structural schematic diagram according to Embodiment 1 of the present invention.
Figure 4:
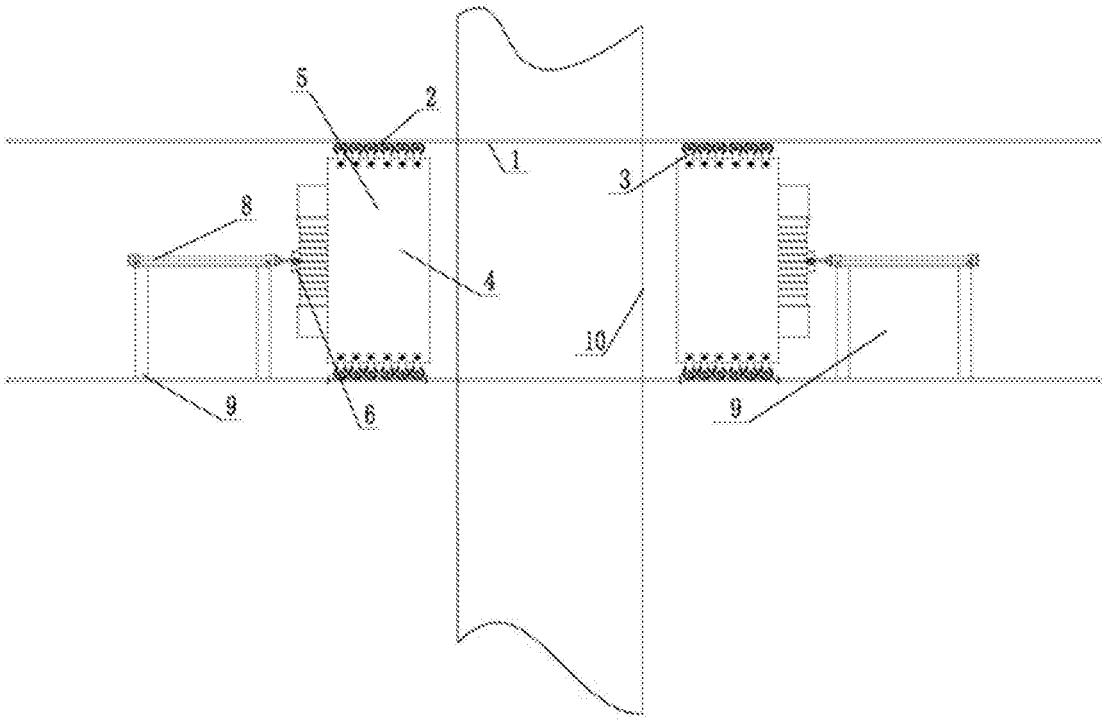
FIG. 4 is a top view of FIG. 1.

As shown in FIG. 1 and FIG. 4, a large-tonnage skip anti-blocking system includes a skip 10, wherein two parallel rows of guide rails 1 are fixed to upper and lower shaft walls of a shaft on two sides of the skip 10 correspondingly, a plurality of pulleys 2 are mounted on the guide rails 1 in a matched mode, impact plates 4 are mounted between the upper and lower pulleys 2, front plates 41 of the impact plates 4 are mounted between the upper and lower sets of pulleys 2 in the front row, rear plates 42 of the impact plates 4 are mounted between the upper and lower sets of pulleys 2 in the back row, a length of rib plates 43 of the impact plates 4 is greater than a width of the skip 10, hydraulic cylinder bases 6 and vibration motors 5 are mounted on outer sides of the rib plates 43 at intervals, one ends of hydraulic cylinders 8 are connected to the hydraulic cylinder bases 6 through buffer springs 7, the other ends of the hydraulic cylinders 8 are connected with the shaft wall of the shaft, and piston rods of the hydraulic cylinders 8 push inner sides of the rib plates 43 of the impact plates 4 to be closely attached to an outer wall of the skip 10 when extending out.

In order to make impact force of the hydraulic cylinders 8 to the skip 10 more even, the hydraulic cylinders 8 are mounted on fixed seats 9, the fixed seats 9 are fixed to a lower end shaft wall of the shaft, and a height of the fixed seats 9 is half a height of the shaft.

Preferably, the hydraulic cylinders 8 are arranged into four sets, and evenly and symmetrically mounted on left and right sides of the skip 10, and a horizontal distance between the two hydraulic cylinders 8 on each side is one third a width of the shaft.

When the height of the shaft is small, one vibration motor 5 is arranged on the outer side of each of the impact plates 4 on two sides, and the vibration motor 5 is mounted between the two hydraulic cylinders 8.

Further, the pulleys 2 are correspondingly connected with the front plates 41 and the rear plates 42 of the impact plates 4 through H-shaped connecting plates 3.

Embodiment 2

Figure 2:
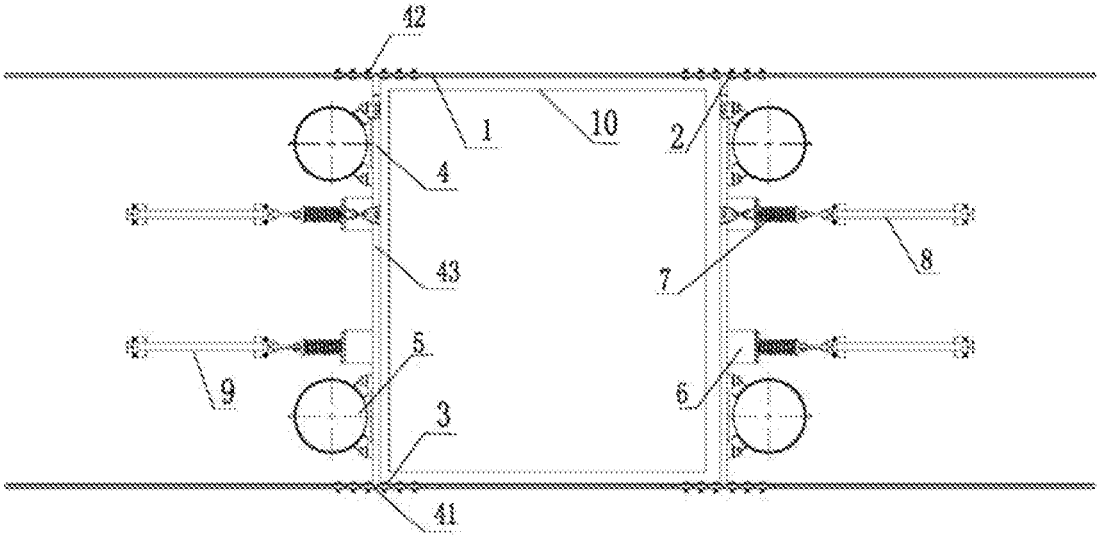
FIG. 2 is a structural schematic diagram according to Embodiment 2 of the present invention.

Different from Embodiment 1, as shown in FIG. 2, when materials are high in humidity and adhesion, two vibration motors 5 are arranged on an outer side of each of impact plates 4 on two sides, and the vibration motors 5 are mounted on two sides of two hydraulic cylinders 8.

Embodiment 3

Figure 3:
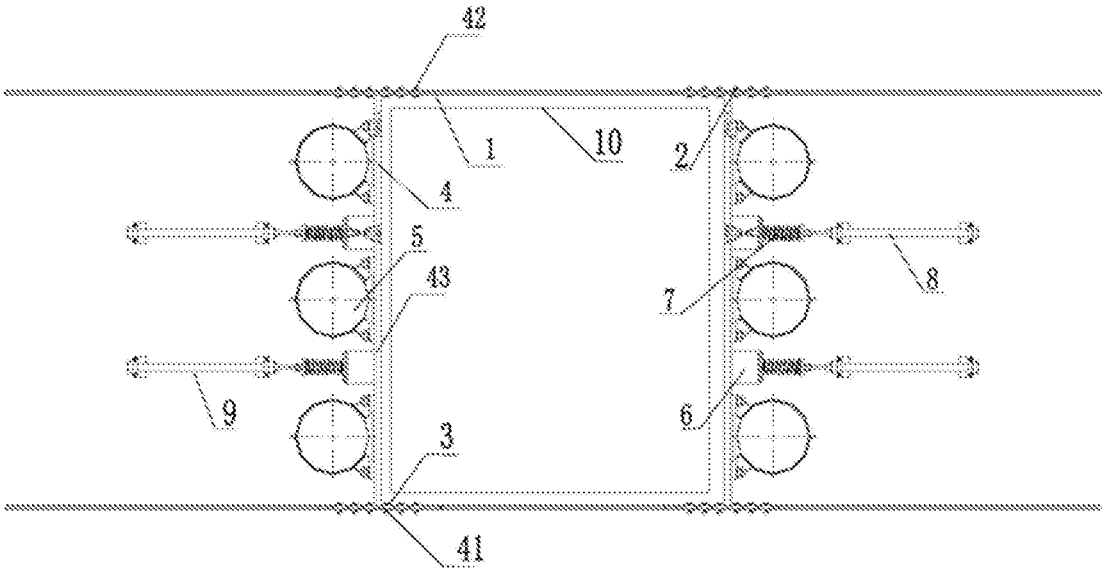
FIG. 3 is a schematic diagram according to Embodiment 3 of the present invention.

Different from Embodiment 1, as shown in FIG. 3, when a height of a shaft is large, three vibration motors 5 are arranged on an outer side of each of the impact plates 4 on two sides, and the vibration motors 5 are mounted on two sides of the two hydraulic cylinders 8 and between the two hydraulic cylinders 8.

When skip blocking is caused by adhering of materials to an inner wall of a skip 10, the hydraulic cylinders 8 push the impact plates 4 to horizontally move towards the skip, when rib plates 43 of the impact plates 4 are closely attached to an outer wall of the skip 10, the vibration motors 5 are started, the materials blocking the inner wall of the skip are shaken off through small-amplitude and high-frequency vibration provided by the vibration motors 5; when adhesion is large, the vibration motors 5 can be stopped, telescopic impact force of the hydraulic cylinders 8 makes the skip 10 generate large-amplitude and high-frequency vibration, and thus blocking caused by the large-adhesion materials is solved; a cooperation effect of extending and retraction of the hydraulic cylinders 8 and the vibration motors 5 may further be utilized to thoroughly remove the blocking materials to make the adhesion materials separated from the inner wall of the skip 10 and unloaded from an unloading opening due to a gravity effect; and buffer springs 7 can reduce force of the vibration motors 5 to be transmitted to the hydraulic cylinders so as to prevent damage to the hydraulic cylinders 8 during vibration of the vibration motors 5.

What is claimed is:

1. A large-tonnage skip anti-blocking system, comprising a skip, wherein two parallel rows of guide rails are fixed to upper and lower well walls of a shaft on both sides of the skip correspondingly, a plurality of pulleys are mounted on the upper well wall, an impact plate is mounted between each of the plurality of upper and lower pulleys, a front plate of each of the impact plates is mounted between each of the plurality of upper and lower pulleys in a front row, a rear of each of the impact plates is mounted between each of the plurality of upper and lower pulleys in a back row, a length of a rib of each of the impact plates is greater than a width of the skip, a hydraulic cylinder base of a hydraulic cylinder and a vibration motor is mounted on an outer side of each respective rib plate of the plurality of rib plates, a first end of each hydraulic cylinder is connected to a corresponding hydraulic cylinder base through a buffer spring, a second end of each hydraulic cylinder is connected with a shaft wall of the shaft, wherein when a piston rod of each of the hydraulic cylinders is extended, an inner side of each of the ribs of each impact plate is pushed to engage an outer wall of the skip.

2. The large-tonnage skip anti-blocking system according to claim 1, wherein each of the hydraulic cylinders is mounted on a fixed seat, each of the fixed seats is fixed to a lower end shaft wall of the shaft, and a height of each of the fixed seats is one-half a height of the shaft.

3. The large-tonnage skip anti-blocking system according to claim 2, wherein the hydraulic cylinders are uniformly spaced and arranged into sets of four and mounted two each on left and right sides of the skip, respectively, and a horizontal distance between two hydraulic cylinders on each side of the skip is one-third a width of the shaft.

4. The large-tonnage skip anti-blocking system according to claim 1, wherein when a height of the shaft is small, one vibration motor of the plurality of vibration motors is arranged on an outer side of each of the impact plates on both sides, and the one vibration motor of the plurality of vibration motors is mounted between two hydraulic cylinders of the plurality of hydraulic cylinders; when materials are high in humidity and adhesion, two vibration motors of the plurality of vibration motors are arranged on the outer side of each of the plurality of impact plates on the both sides, and the two vibration motors of the plurality of vibration motors are mounted on two sides of the two hydraulic cylinders of the plurality of hydraulic cylinders; and when the height of the shaft is high, three vibration motors of the plurality of vibration motors are arranged on the outer side of each of the plurality of impact plates on the both sides, and the three vibration motors of the plurality of vibration motors are mounted on the two sides of the two hydraulic cylinders of the plurality of hydraulic cylinders and between the two hydraulic cylinders of the plurality of hydraulic cylinders.

5. The large-tonnage skip anti-blocking system according to claim 4, wherein each of the plurality of upper and lower pulleys is connected with a corresponding front plate and a corresponding rear plate through an H-shaped connecting plate, respectively.

6. The large-tonnage skip anti-blocking system according to claim 4, wherein each of the hydraulic cylinders is mounted on a fixed seat, each of the fixed seats is fixed to a lower end shaft wall of the shaft, and a height of each of the fixed seats is one-half a height of the shaft.

7. The large-tonnage skip anti-blocking system according to claim 4, wherein each of the hydraulic cylinders is mounted on a fixed seat, each of the fixed seats is fixed to a lower end shaft wall of the shaft, and a height of each of the fixed seats is one-half a height of the shaft; the hydraulic cylinders are uniformly spaced and arranged into sets of four and mounted two each on left and right sides of the skip, respectively, and a horizontal distance between two hydraulic cylinders on each side of the skip is one-third a width of the shaft.

* * * * *